US005403201A

United States Patent [19]

McCarthy

[11] Patent Number: 5,403,201

[45] Date of Patent: Apr. 4, 1995

[54] ELECTRICAL CONNECTOR

[76] Inventor: Dale C. McCarthy, 2031 26th St., NW., Winter Haven, Fla. 33881

[21] Appl. No.: 106,523

[22] Filed: Aug. 16, 1993

[51] Int. Cl.[6] ..... H01R 4/24

[52] U.S. Cl. ..... 439/427; 439/425; 439/441

[58] Field of Search ..... 439/438–441, 439/586, 595, 599, 351–358, 417–419, 425, 426, 427

[56] References Cited

U.S. PATENT DOCUMENTS

| | | | |
|---|---|---|---|
| 2,647,246 | 7/1953 | Gilbert | 439/419 |
| 2,719,957 | 10/1955 | Abbot | 439/425 |
| 3,860,320 | 1/1975 | Danner | 339/100 |
| 4,013,333 | 3/1977 | Chang | 339/98 |
| 4,091,233 | 5/1978 | Berman | 174/88 |
| 4,722,579 | 2/1988 | Cummings | 439/441 |
| 4,786,760 | 11/1988 | Friedhelm | 174/84 |
| 4,968,268 | 11/1990 | Oh | 439/425 |
| 5,263,878 | 11/1993 | Lai | 439/441 |

*Primary Examiner*—David L. Pirlot
*Attorney, Agent, or Firm*—William M. Hobby, III

[57] ABSTRACT

An electrical connector for coupling to an insulated electrical conductor includes an insulated housing having a bore therein shaped to receive an insulated wire end. An electrically conductive pointed prong is attached in the housing with the pointed prong extending axially within the bore. An electrical conductor is attached to the opposite end of the pointed prong and extends from the housing for conducting an electrical current therethrough. At least one clamp is positioned in the housing extending into the bore towards the pointed prong for clamping onto the wire insulation of an insulated conductor wire inserted into the bore to hold the wire end within the bore. The clamp can be positioned at an angle to allow the easy insertion of the wire end while preventing its removal without the lifting of the clamp. The housing can have a plurality of bores and with therein and the plurality of clamps can be spring loaded with a grip means for releasing each clamp to remove the wire end from the bore.

5 Claims, 1 Drawing Sheet

ELECTRICAL CONNECTOR

BACKGROUND OF THE INVENTION

The present invention relates to electrical connectors and especially to an electrical connector for coupling to an insulated electrical conductor without stripping the end of the insulated electrical conductor.

In the past, a wide variety of electrical wire connectors have been provided for connecting to wire ends. In a typical connector, the end of the wire is stripped of insulation and the bare wire is inserted into a connector where it can be soldered or clamped or otherwise attached to the connector. It is also common to tin the wire ends by coating the wire end with solder and a wide variety of connectors have been provided which removably hold the wire to the connector.

Typical connectors are seen in audio systems, such as in hi-fi speakers in which a wire end is stripped of the insulation and is inserted in an opening and a threaded nut is threaded down onto the wire, the nut can be loosened for removing the wire. Other audio speakers include spring clamps which allows a wire end to be stripped of insulation and inserted into an opening while lifting the spring connector clamp and then releasing the spring connector clamp onto the wire. Relifting of the spring connector clamp allows the removal of the wire end. Other commonly used connectors allow a stripped wire end to be inserted into a connector or into both ends of a connector and then clamped with pliers to collapse a conductive sleeve onto the wire. This type of connector can be insulated or not as desired since it is made of a malleable metal in which the collapsing onto the stripped wire end provides the necessary electrical contact.

In contrast to these various types of wire connectors, the present invention deals with a wire connector that does not require the insulation to be stripped and also provides, in some embodiments, for the insertion of the insulated wire end in a manner to lock the wire end in place inside the bore of a wire connector.

Prior wire connectors can be seen in the following U.S. Patents. The Chang U.S. Pat. No. 4,013,333, for a wire connector having two concentric sockets adapted to be assembled one into the other and in which the inner socket has a conductive needle mounted therein for sliding a wire end into each end of the connector and which also uses a spike pressed in two holes in the sleeves to penetrate the coating of the wire ends. In the U.S. patent to Danner, U.S. Pat. No. 3,860,320, a dangler cathode cable assembly is connected to a ball-like cathode member by stripping the end portion of the cable and inserting the end portion into a sleeve which is pressed into an undersized tapered socket and which has a pointed pin therein. In the U.S. patent to Friedhelm, U.S. Pat. No. 4,786,760, a cable connector for piezoelectric cable has an insulated cable end which is inserted into a sleeve. In the U.S. patent to Burman, U.S. Pat. No. 4,091,233, an electrical connector and a method of connecting an electrical cable to the connector is provided for connecting one or more insulated electrical cords or cables together. The insulated cable ends can be inserted into the receptacles on either end and onto a prong of electrically conductive material so that the prong is an electrical contact with the wire of an insulated cord end. A container of adhesive material on the end of the receptacle is released from the container to create a physical bond between the cord and the connector to hold the cord within the connector.

The present invention utilizes an electrical connector for coupling to an insulated electrical conductor end which is inserted into a bore on a housing to drive a prong into the conductor end and which includes means for releasably clamping and holding the insulated wire end within the electrical connector.

SUMMARY OF THE INVENTION

An electrical connector for coupling to an insulated electrical conductor includes an insulated housing having a bore therein shaped to receive an insulated wire end. An electrically conductive pointed prong is attached in the housing with the pointed prong extending axially within the bore. An electrical conductor is attached to the opposite end of the pointed prong and extends from the housing for conducting an electrical current therethrough. At least one clamp is positioned in the housing extending into the bore towards the pointed prong for clamping onto the wire insulation of an insulated conductor wire inserted into the bore to hold the wire end within the bore. The clamp can be positioned at an angle to allow the easy insertion of the wire end while preventing its removal without the lifting of the clamp. The housing can have a plurality of bores and with therein and the plurality of clamps can be spring loaded with a grip means for releasing each clamp to remove the wire end from the bore.

BRIEF DESCRIPTION OF THE DRAWINGS

Other objects, features, and advantages of the present invention will be apparent from the written description and the drawings in which.

DESCRIPTION OF THE PREFERRED EMBODIMENTS

Figure 1:
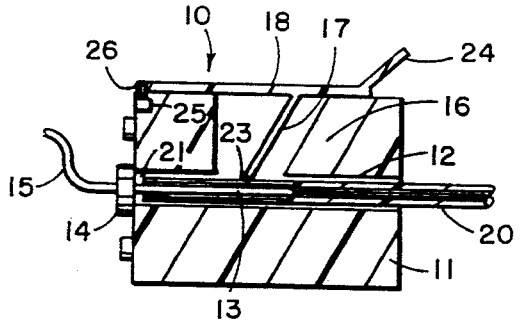
FIG. 1 is a side sectional view of an electrical connector having an insulated wire end connected thereto.
Figure 2:
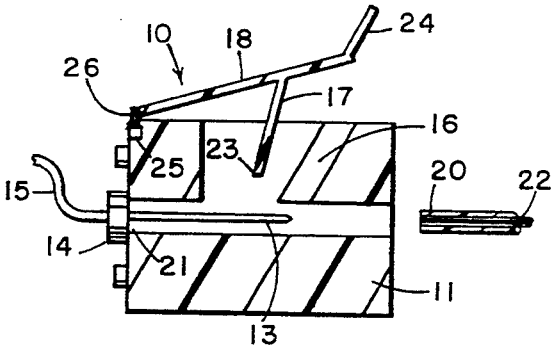
FIG. 2 is a side sectional view of the connector in accordance with FIG. 1 having the wire end removed.

Referring to the drawings, FIGS. 1 and 2, an electrical connector 10 is shown having a non-conducting body 11 which can be a plastic or polymer body formed with a bore 12 therein. An elongated pointed prong 13 is made of an electrical conductive material and has one end attached to the rear of the body 11 to a supporting member 14 having an electrical conductor 15 extending therefrom. The insulating connector body 11 has an open area 16 having a clamp member 17 extending therethrough and attached to a hinged member 18. The clamp member 17 extends into the bore 12 at an angle as shown so that an insulated wire 20 having a tip 21 can be inserted into the bore 12 and pushed onto the axially protruding prong 13 extending through the center of the bore 12. The insulated wire end pushes against the spring clamp 17 to lift it to push the tip 21 into the end of the bore 12. The clamp member 17 can be positioned at an angle so that pushing there against by the insulation 21 surrounding the conductive wire 22 of the wire end 20 pushes it out of the way. Attempting to pull the wire end 20 out of the bore 12 will engage the point 23 further into the insulation 21 and to prevent the removal of the wire 20 once inserted in the bore 12. An electrical conducting prong having been inserted into the center of the insulated wire end 20 makes electrical contact with the conductive wire 22 and makes a conductor through the wire 15 from the connector 10.

If the wire has to be removed, the prong 17 supporting hinged member 18 has a grip 24 thereon which can be grabbed to lift the members on the hinge 25. Hinge 25 has a spring 26 to spring load it. Thus, the member 24 can be lifted to pull the clamping prong 17 away from the wire 20 inserted into the bore 12 while the wire 20 is pulled from the bore 12 at which time the grip 24 can be released and the spring 26 closes the prong 17 in a position to receive another wire end 20.

To make a complete electrical connection, a wire end is inserted into the bore 12 which makes an electrical connection without having to trim the insulation. The electrical connection is such that it cannot be removed without lifting the handle 24 to release the holding clamp 17. It should be clear in FIG. 1 that the member 18 and clamp 17 can be one member which can be of a spring metal and not require a hinge 26 to spring load the clamp 17 into the bore 12 against the wire insulation 21 of a wire end 20 which can still be lifted against its own spring force.

Figure 3:
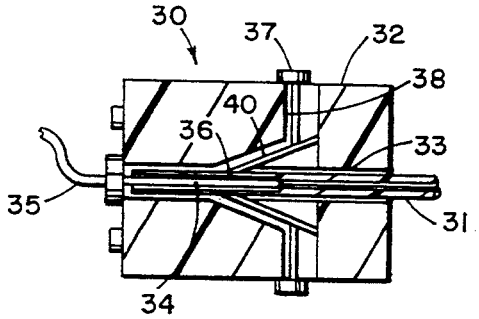
FIG. 3 is a side sectional view of a second embodiment of an electrical connector.

Referring to FIG. 3, a second embodiment of an electrical connector 30 is illustrated having an insulated wire end 31 inserted into an insulated housing 32, bore 33 and onto an electrical conductive prong 34 axially aligned within the bore 33. The prong 34 is attached to the housing 32 and has a conductive lead 35 extending from the rear thereof so that an insulated wire end 31 inserted into the bore 33 is inserted onto the conductive prong 34 axially aligned in the bore 33 to make an electrical contact within the insulation of the wiring 31 to maintain the electrical continuity through the conductor 35. Extending from a portion of the housing is a pair of pointed clamp 36 which are angled inward so that the wire 31 being pushed thereinto pushes against the angle surface of the clamp 36 to push them out of the way while the wire slides further into the bore 33. The clamps 36 prevent the wire from being pulled from the connector 30 by the spring force of the clamps 36 pointed ends pushing into the insulation on the wire tip 31. A pair of release buttons 37 have a pin 38 attached thereto and attached to prongs 36 which is of a spring metal so that pushing upon the metal prongs 36 behind a lever point 40 will cause the spring tips 36 to flex away from the insulation of the wire tip 31 to allow the wire tip 31 to be removed from the bore 33.

Figure 4:
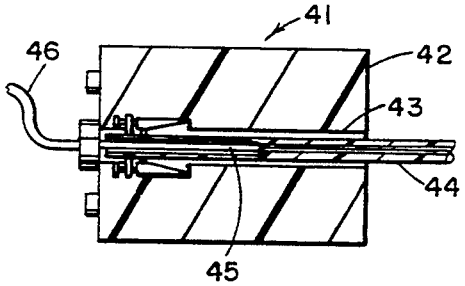
FIG. 4 is a side sectional view of a third embodiment of an electrical connector in accordance with the present invention.
Figure 5:
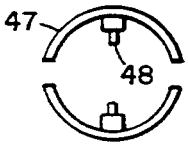
FIG. 5 is a sectional view of a clamp of the connector of FIG. 4.

Turning to FIG. 4, another embodiment 41 of an electrical connector is illustrated having an insulated housing 42 having a bore 43 therein and having an insulated wire end 44 in the bore 33 and pushed on to the conductive prong 45 axially aligned in the bore 43 and electrically connected to an electrical conductor 46 to provide electrical continuity between the wire 44 and electrical conductor 46 without having to trim the insulation on the tip of the wire 44. In this embodiment, a pair of clamps 47 have a pair of pointed prongs 48 thereon. Clamps 47 are arcuate shaped and can be pushed to bend the metal of the clamps 47 to push the clamp's pointed ends 48 into the insulation of the wire 44 to clamp and hold the wire 44 inside the bore 43.

Figure 6:
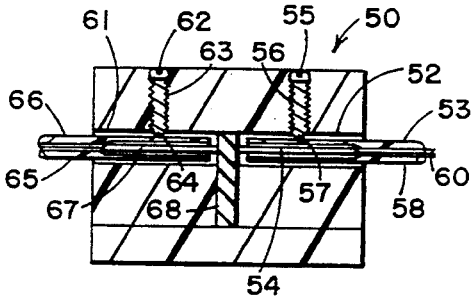
FIG. 6 is a side sectional view of another embodiment of an electrical connector in accordance with the present invention.
Figure 7:
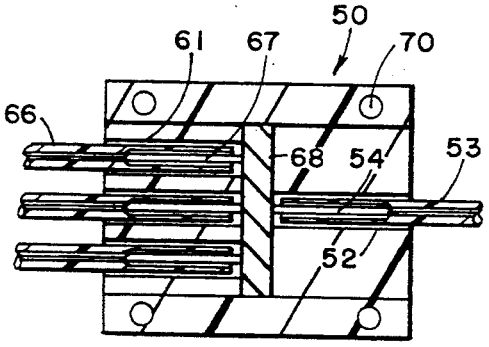
FIG. 7 is a top sectional view of the electrical connector of FIG. 6.

Turning to FIGS. 6 and 7, another embodiment of an electrical connector 50 is illustrated having an insulating body 51 having a bore 52 on one side thereof and an insulating conductor 53 inserted in the bore 51 onto a conducting prong 54 axially aligned within the bore 52. A threaded fastener 55 is mounted in a threaded bore 56 on top of the housing 51 and has a pointed end 57 so that it can be threaded into the side of the insulation 58 covering the conductive cable portion 60 of the wire end 53. In this embodiment, the housing 51 has a plurality of second bores 61 on the opposite side thereof, each having its own threaded fastener 62 threaded into bores 63 perpendicular to the bore 61, and each fastener having a pointed end 64 for driving into the insulation 65 of a inserted wire end 66. Wire end 66 has been inserted into a metal conducting prong 67 to provide electrical conduction to the wire end 66. Each of the plurality of bores 61 having a prong 67 is electrically connected to a center bus 68 on one side while the singe prong 54 is connected to the same electrical bus 68 from the other to provide electrical continuity between the wire 53 inserted on the prong 54 and the bore 52 and the plurality of wires 66 inserted into each of the bores 61 and onto the prong 67. A plurality of apertures 70 allows this electrical connector, as in FIGS. 6 and 7, to be attached to a surface. Threaded fasteners 55 and 62 allow the wires to be clamped in and rapidly released for changing the wire connections.

Figure 8:
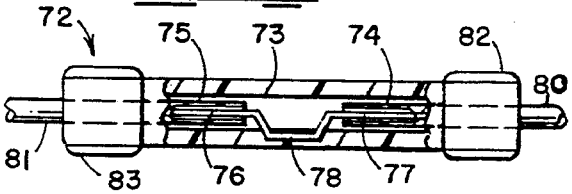
FIG. 8 is a side sectional view of another embodiment of an electrical connector in accordance with the present invention.

Turning to FIG. 8, an electrical connector 72 is illustrated having an insulated body 73 with a pair of bores 74 and 75 inserted from each end. The bore 75 has a prong 76 axially aligned therein while the bore 74 has an axial prong 77 therein. The two prongs 76 and 77 are connected as a single prong within the housing 73 at the flat surface 78 which is attached to the sleeve 73. In this embodiment, insulated conductive wires 80 have been inserted into the bore 73 onto the prong 77 while an insulating wire 81 has been inserted into the bore 75 onto the prong 76. A plastic or shrink wrapping sleeve 82 has been formed on the end of the sleeve 73 so that the wire 80 can be heat shrunk onto the wire 80. A similar heat shrinking plastic 83 has been attached to the housing 73 at the other end and has the wire 83 extending therethrough so that the plastic can be heat shrunk thereon.

It should be clear at this time that an electrical connector has been provided in several embodiments which advantageously allows the rapid connection of an insulated wire end without stripping the wire or tinning the end of the wire and which leaves a fully insulated connector and which can be rapidly released and replaced. It should, however, also be clear that the present invention is not to be limited to the forms shown which are to be considered illustrative rather than restrictive.

I claim:

1. An electrical connector for coupling to an insulated electrical conductor comprising:

an insulated housing having a bore in one end thereof shaped to receive an insulated wire end therein;

at least one electrically conductive pointed prong having two end portions, said pointed prong having one end portion attached to said housing and having a second end portion protruding axially in said bore in said housing;

an electrical conductor being attached to said pointed prong at one end and extending from said housing for conducting electricity therethrough;

at least one spring clamp formed in said housing and extending from inside said housing into said bore towards said pointed prong for clamping onto a wire inserted into said bore onto said pointed prong, said at least one spring clamp having a grip connected thereto for moving said pointed prong end from engagement with the insulated wire tip and said at least one spring clamp being positioned at an inward angle in said bore to thereby engage said insulation on an insulated wire tip when the wire tip is inserted in said bore onto said pointed prong to thereby prevent said insulated wire tip from being removed from said bore until said grip lifts said clamp and said at least one spring clamp having a spring biasing said clamp towards said pointed prong and into engagement with an insulated wire tip;

whereby an insulated conductor can be rapidly connected to a connector with an electrical connection without removing the insulation from the end of the wire.

2. An electrical connector for coupling to an insulated electrical conductor in accordance with claim 1 in which said insulated housing has a plurality of bores therein and at least one electrically conductive pointed prong attached to said housing and extending into each said housing bore whereby a plurality of insulated wire ends can be electrical connected thereto.

3. An electrical connector for coupling to an insulated electrical conductor in accordance with claim 1 in which said at least one clamp and spring is formed from one piece of metal and attached to said insulated housing.

4. An electrical connector for coupling to an insulated electrical conductor in accordance with claim 1 in which said insulated housing is made of a polymer material.

5. An electrical connector for coupling to an insulated electrical conductor in accordance with claim 1 in which said pointed prong is made of an electrically conductive metal.

* * * * *